US010321212B2

(12) United States Patent
De Haan et al.

(10) Patent No.: US 10,321,212 B2
(45) Date of Patent: Jun. 11, 2019

(54) LOUDSPEAKER ARRAY SUSPENSION

(71) Applicant: Alcons Audio B.V., Zwaag (NL)

(72) Inventors: Philip Derek Eduard De Haan, Zwaag (NL); Boudewijn Groen, Zwaag (NL)

(73) Assignee: Alcons Audio B.V., Zwaag (NL)

( * ) Notice: Subject to any disclaimer, the term of this patent is extended or adjusted under 35 U.S.C. 154(b) by 50 days.

(21) Appl. No.: 15/564,937

(22) PCT Filed: Apr. 13, 2016

(86) PCT No.: PCT/EP2016/058105
§ 371 (c)(1),
(2) Date: Oct. 6, 2017

(87) PCT Pub. No.: WO2016/166150
PCT Pub. Date: Oct. 20, 2016

(65) Prior Publication Data

US 2018/0109859 A1 Apr. 19, 2018

(30) Foreign Application Priority Data

Apr. 14, 2015 (NL) ..... 2014636

(51) Int. Cl.
*H04R 1/00* (2006.01)
*H04R 1/02* (2006.01)
*H04R 1/40* (2006.01)

(52) U.S. Cl.
CPC ..... *H04R 1/026* (2013.01); *H04R 1/403* (2013.01)

(58) Field of Classification Search
CPC . H04R 1/02; H04R 1/026; H04R 1/26; H04R 1/403; H04R 2201/401; H04R 2201/403; H04R 29/002
See application file for complete search history.

(56) References Cited

U.S. PATENT DOCUMENTS 5,819,959 A * 10/1998 Martin ..... H04R 1/026 211/118
6,640,924 B2 * 11/2003 Messner ..... H04R 1/026 181/144

(Continued)

FOREIGN PATENT DOCUMENTS

WO WO-2011005093 1/2011

*Primary Examiner* — Matthew A Eason
(74) *Attorney, Agent, or Firm* — Marcus C. Dawes

(57) ABSTRACT

A loudspeaker array suitable for use in both a compression suspension mode and a flying suspension mode, wherein each two adjacent loudspeakers housings are coupled to each other by coupling means comprising a stationary connection frame, a pivotable connection bar and a connection member; wherein one of the connection frame and bar is provided with a fly mode pulling connection member stop and a compression mode pushing connection member stop which each are arranged to receive and block movement of the connection member in two opposite directions, one being a fly mode direction and one being a compression mode direction, such that blocking the movement of said connection member in the fly mode direction causes the back sides of the loudspeaker housings to exert a pulling force on each other while maintaining a predetermined angle and blocking the movement of said connection member in the compression mode direction causes the back side of said loudspeaker housings to exert a pushing force on each other while maintaining a predetermined angle.

24 Claims, 5 Drawing Sheets

(56) References Cited

U.S. PATENT DOCUMENTS

| | | | | |
|---|---|---|---|---|
| 7,298,860 | B2 * | 11/2007 | Engebretson | H04R 1/026 381/335 |
| 7,516,932 | B2 * | 4/2009 | Engebretson | H04R 1/026 248/317 |
| 7,634,100 | B2 * | 12/2009 | Monitto | H04R 1/026 381/335 |
| 8,130,996 | B2 * | 3/2012 | Kling | H04R 1/026 181/144 |
| 8,165,334 | B2 * | 4/2012 | Iwayama | H04R 1/26 381/386 |
| 8,600,097 | B2 * | 12/2013 | McGhee | H04R 1/02 181/198 |
| 9,516,396 | B2 * | 12/2016 | Andrews | H04R 1/025 |
| 10,129,621 | B2 * | 11/2018 | Christner | B62B 5/0093 |
| 2004/0213425 | A1 * | 10/2004 | Simidian, II | H04R 1/026 381/335 |
| 2007/0000719 | A1 * | 1/2007 | Bothe | H04R 1/026 181/150 |
| 2012/0093347 | A1 * | 4/2012 | Adamson | H04R 1/026 381/300 |
| 2012/0189420 | A1 * | 7/2012 | Kemper | H04R 1/026 414/800 |
| 2013/0208936 | A1 * | 8/2013 | McGhee | H04R 1/026 381/332 |
| 2013/0240288 | A1 * | 9/2013 | Givre | H04R 1/026 181/199 |
| 2014/0353074 | A1 * | 12/2014 | Bridge | H04R 31/006 181/145 |
| 2015/0208150 | A1 * | 7/2015 | Spillmann | H04R 1/02 381/387 |
| 2018/0007456 | A1 * | 1/2018 | Spillmann | H04R 1/026 |

* cited by examiner

LOUDSPEAKER ARRAY SUSPENSION

The present invention relates to a loudspeaker array, comprising at least two loudspeaker housings, wherein each two adjacent loudspeakers housings are coupled to each other by coupling means; wherein said coupling means comprises a hinge connecting the front sides of said adjacent loudspeaker housings; wherein said coupling means are designed to couple said adjacent loudspeakers in such a manner that the loudspeaker housings will extend at a predetermined angle relative to each other in a hoisted position, and provided with means for setting the predetermined angle when the loudspeaker housings are in a non-hoisted position; and wherein the coupling means are further designed for coupling the loudspeaker housings in such a manner that said loudspeaker housings, upon being moved from the non-hoisted position to the hoisted position, are be moved to a position wherein the loudspeaker housings are forced to extend at said predetermined angle. Such a coupling system is known, for example from U.S. Pat. No. 7,261,180.

A drawback of the known system is the fact that the angle between two loudspeaker housings must be set with the loudspeaker housings in a hoisted position, so that forces caused by gravity are exerted on the loudspeaker housings. Said forces may also lead to accidents, for example in that a person's fingers can get jammed between two loudspeaker housings upon setting the aforesaid angle.

Systems are known for use in a fly mode suspension system wherein the angle between the speakers can be set in advance in a non-hoisted position and wherein the angle is achieved by hoisting the array from a horizontal position such that the back sides of the speakers are pushed against each other, and then let gravity pull the back sides of the speakers away from each other towards the set angle, such as described in US 2007/0000719 A1, WO 2011/005093 A1. Also systems are known for use in a compression mode suspension system wherein the angle between the speakers can be set in advance in a non-hoisted position and wherein a tensioning cable is used to pull the back sides of the speakers towards each other towards the set angle, such as described in US 2013/0240288 A1.

It is an object of the invention to provide a coupling system for coupling loudspeaker housings, which is more flexible in use, and/or which is reliable and/or efficient, and/or wherein an angle between two loudspeaker housings can be set in a simple and/or efficient manner and/or correctly and/or quickly, and/or wherein the risk of accidents is reduced, and/or provides other advantages.

According to a first aspect of the invention a loudspeaker array is provided which is suitable for use in both a compression suspension mode and a flying suspension mode, comprising at least two loudspeaker housings, wherein each two adjacent loudspeakers housings are coupled to each other by coupling means; wherein said coupling means comprises a hinge connecting the front sides of said adjacent loudspeaker housings; wherein said coupling means are designed to couple said adjacent loudspeakers in such a manner that the loudspeaker housings will extend at a predetermined angle relative to each other in a hoisted position, and provided with means for setting the predetermined angle when the loudspeaker housings are in a non-hoisted position; wherein the coupling means are further designed for coupling the loudspeaker housings in such a manner that said loudspeaker housings, upon being moved from the non-hoisted position to the hoisted position, are moved to a position wherein the loudspeaker housings are forced to extend at said predetermined angle; wherein said coupling means comprise a pivotable connection bar which at one end is pivotably connected to a back side of one of said adjacent loudspeakers, and a stationary connection frame mounted on a back side of the other one of said adjacent loudspeakers and to which the other end of said connection bar can be coupled by means of a connection member; wherein one of said connection frame and bar is provided with a plurality of holders which are arranged to hold said connection member, and arranged such that a selection of each one of said holders by rotating said connection bar for holding said connection member and coupling said connection bar to said connection frame determines a different said predetermined angle; and wherein the other one of said connection frame and bar is provided with a fly mode pulling connection member stop and a compression mode pushing connection member stop which each are arranged to receive and block movement of said connection member in two opposite directions, one being a fly mode direction and one being a compression mode direction, such that blocking the movement of said connection member in the fly mode direction causes the back sides of said loudspeaker housings to exert a pulling force on each other while maintaining said predetermined angle and blocking the movement of said connection member in the compression mode direction causes the back side of said loudspeaker housings to exert a pushing force on each other while maintaining said predetermined angle.

Preferably the designated connection member locations of said fly mode connection member stop and said compression mode connection member stop are located at the same distance from the pivot point of said pivotable connection bar. Preferably said connection member stops are formed by the ends of slots wherein said connection member can move. Preferably said slots extend in the fly mode and compression mode directions respectively, each of said directions extending through the pivot point of said pivotable connection bar. Preferably said plurality of holders for holding said connection member extends in an array in a direction which is substantially perpendicular to the fly mode and compression mode directions.

Preferably said loudspeaker array is provided with a tension cable, one end of which is attached to the back side of the lower loudspeaker in said loudspeaker array, and one end of which is attached near the upper side of said loudspeaker array, and means for tensioning said cable in order to move said connection members in the compression mode direction towards the compression mode connection member stops.

Preferably said loudspeaker array is designed such that when the upper loudspeaker of said loudspeaker array is hoisted gravity forces said loudspeakers to move such that said connection members move in the fly mode direction towards the fly mode connection member stops. Preferably said plurality of holders is provided in the stationary connection frame and the connection member is provided in the pivotable connection bar. Preferably said connection member is a pin. Preferably said holder is a pin hole in which a pin can be inserted.

Preferably said connection frame or bar which is provided with said holders for said connection member is provided with a support surface extending in a segment of a circle, the centre of said circle being the pivot point of said pivotable connection bar when said loudspeaker array is in the non-hoisted position; wherein the other one of said connection frame and bar is provided with a removable support member which is arranged to push against and be movable along said support surface when said connection bar is rotated in order to hold said loudspeaker array standing upright in the non-hoisted position, which removable support member can be removed when the loudspeaker array is hoisted in order to allow a tension cable, one end of which is attached to the back side of the lower loudspeaker in said loudspeaker array, and one end of which is attached near the upper side of said loudspeaker array, and means for tensioning said cable, to move said connection members in the compression mode direction towards the compression mode connection member stops.

Preferably said connection frame or bar which is provided with said holders for said connection member is provided with a second support surface extending in a segment of a circle, the centre of said circle being the pivot point of said pivotable connection bar when said loudspeaker array is in the non-hoisted, stretched position; wherein the other one of said connection frame and bar is provided with a second support member which is arranged to push against and be movable along said support surface in order to hold said loudspeaker array in a stretched position when the loudspeaker array is hoisted.

According to a second aspect of the invention a loudspeaker array is provided, which is suitable for use in a compression suspension mode, comprising at least two loudspeaker housings, wherein each two adjacent loudspeakers housings are coupled to each other by coupling means; wherein said coupling means comprises a hinge connecting the front sides of said adjacent loudspeaker housings; wherein said coupling means are designed to couple said adjacent loudspeakers in such a manner that the loudspeaker housings will extend at a predetermined angle relative to each other in a hoisted position, and provided with means for setting the predetermined angle when the loudspeaker housings are in a non-hoisted position; wherein the coupling means are further designed for coupling the loudspeaker housings in such a manner that said loudspeaker housings, upon being moved from the non-hoisted position to the hoisted position, are moved to a position wherein the loudspeaker housings are forced to extend at said predetermined angle; wherein said coupling means comprise a pivotable connection bar which at one end is pivotably connected to a back side of one of said adjacent loudspeakers, and a stationary connection frame mounted on a back side of the other one of said adjacent loudspeakers and to which the other end of said connection bar can be coupled by means of a connection member; wherein one of said connection frame and bar is provided with a plurality of holders which are arranged to hold said connection member, and arranged such that a selection of each one of said holders by rotating said connection bar for holding said connection member and coupling said connection bar to said connection frame determines a different said predetermined angle; and wherein the other one of said connection frame and bar is provided with a compression mode pushing connection member stop which is arranged to receive and block movement of said connection member in a compression mode direction, such that blocking the movement of said connection member in the compression mode direction causes the back side of said loudspeaker housings to exert a pushing force on each other while maintaining said predetermined angle.

Preferably said connection frame or bar which is provided with said holders for said connection member is provided with a support surface extending in a segment of a circle, the centre of said circle being the pivot point of said pivotable connection bar when said loudspeaker array is in the non-hoisted, stretched position; wherein the other one of said connection frame and bar is provided with a removable support member which is arranged to push against and be movable along said support surface when said connection bar is rotated in order to hold said loudspeaker array standing upright in the non-hoisted, stretched position, which removable support member can be removed when the loudspeaker array is hoisted in order to allow a tension cable, one end of which is attached to the back side of the lower loudspeaker in said loudspeaker array, and one end of which is attached near the upper side of said loudspeaker array, and means for tensioning said cable, to move said connection members in the compression mode direction towards the compression mode connection member stops.

Preferably said connection frame or bar which is provided with said holders for said connection member is provided with a second support surface extending in a segment of a circle, the centre of said circle being the pivot point of said pivotable connection bar when said loudspeaker array is in the non-hoisted, stretched position; wherein the other one of said connection frame and bar is provided with a second support member which is arranged to push against and be movable along said support surface in order to hold said loudspeaker array in a stretched position when the loudspeaker array is hoisted.

Preferably said connection member stops are formed by the ends of slots wherein said connection member can move. Preferably said slot extends in the compression mode direction, extending through the pivot point of said pivotable connection bar. Preferably said plurality of holders for holding said connection member extends in an array in a direction which is substantially perpendicular to the compression mode direction. Preferably said plurality of holders is provided in the stationary connection frame and the connection member is provided in the pivotable connection bar. Preferably said connection member and/or support member(s) is/are a pin. Preferably said holder is a pin hole in which a pin can be inserted.

According to a further preferred embodiment of the second aspect of the invention, the loudspeaker array is suitable for use in both a compression suspension mode and a flying suspension mode, wherein the other one of said connection frame and bar is provided with a fly mode pulling connection member stop which is arranged to receive and block movement of said connection member in a fly mode direction being opposite to said compression mode direction, such that blocking the movement of said connection member in the fly mode direction causes the back sides of said loudspeaker housings to exert a pulling force on each other while maintaining said predetermined angle.

Preferably the designated connection member locations of said fly mode connection member stop and said compression mode connection member stop are located at the same distance from the pivot point of said pivotable connection bar.

Preferably said loudspeaker array is designed such that when the upper loudspeaker of said loudspeaker array is hoisted gravity forces said loudspeakers to move such that said connection members move in the fly mode direction towards the fly mode connection member stops.

The invention will now be explained in more detail with reference to the preferred embodiment as shown in the figures, in which.

Figure 1:
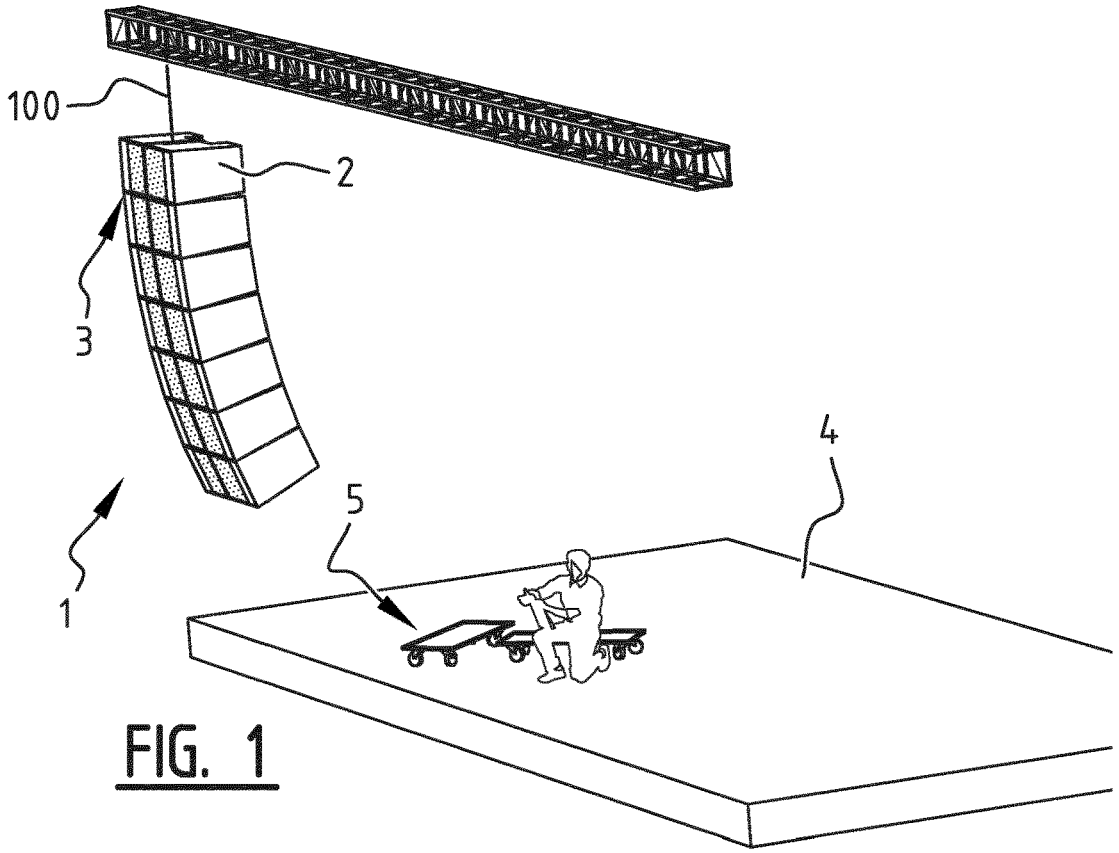
FIG. 1 is a perspective view of a hoisted loudspeaker array.

FIG. 1 shows an array of loudspeaker housings 2, which comprises at least one loudspeaker. In said row, respective loudspeaker housings 2 are disposed vertically below or above next loudspeaker housings 2, with the uppermost loudspeaker housing being suspended from a chain 100, for example. As FIG. 1 shows, the loudspeaker housing 2 is higher at the front side than at the rear side. When a block-shaped loudspeaker housing is used, this shape can be realised by mounting a spacer at the front side. The loudspeaker housings 2 extend vertically at an angle 3 relative to each other, which angle 3 is determined and preset in advance. In the case of large distances, a high sound pressure is important, so that the sound can be clearly heard from a large distance by an audience. To achieve this, the angle 3 between two loudspeaker housings 2 is preferably small, so that the two loudspeakers in the housings will optimally interact. In the case of smaller distances, on the other hand, the sound pressure must be lower, so that a larger angle between two loudspeaker housings 2 is desired, with the maximum angle preferably ranging between 0° and 15°, or between 0° and 6°, depending on the size of the sound system. The presence of said angles 3 appears from FIG. 1, in that the row 1 exhibits a curvature from the top downwards, in the direction of the stage 4.

FIG. 1 furthermore shows the loudspeaker array in the so-called "flying mode". When the loudspeaker housings 2 are being hoisted in flying mode, a so-called dolly 5, which comprises a plate provided with wheels and which extends against the front side of a loudspeaker 2 in use, is removed from successive loudspeaker housings 2, preferably at man height. When the loudspeaker housings 2 are being lowered, said dollies 5 are, on the contrary, connected to the front side of respective loudspeaker housings 2, so that the loudspeaker housings 2 can rest on the dollies 5. As appears from FIG. 1, the loudspeaker housings 2 only extend at the predetermined angle 3 in the hoisted condition, with the loudspeaker housings 2 assuming the angular position under the influence of gravity through the use of a coupling system while being hoisted. The working of the coupling mechanism in the flying mode will be explained in more detail with reference to FIGS. 5A-C. The loudspeaker housings 2 can also be hoisted in the so-called "compression mode", which will be explained in more detail with reference to FIGS. 6 A-C.

Figure 2:
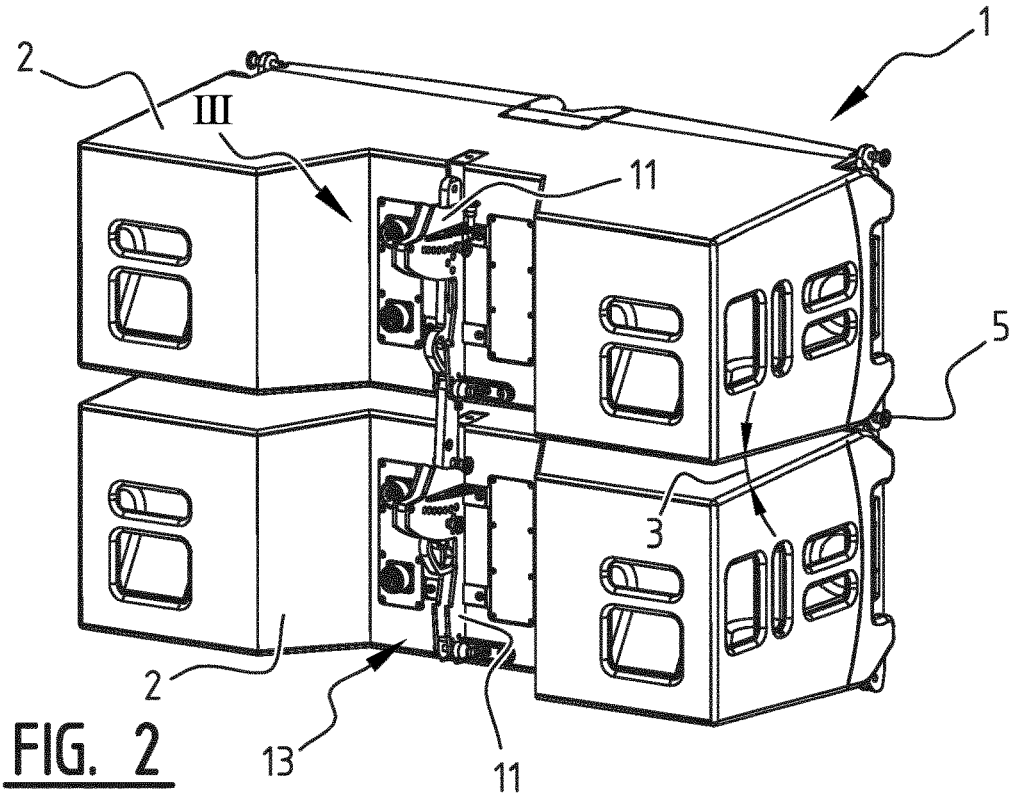
FIG. 2 is a perspective view of the back side of two adjacent speakers of the loudspeaker array of FIG. 1.
Figure 3:
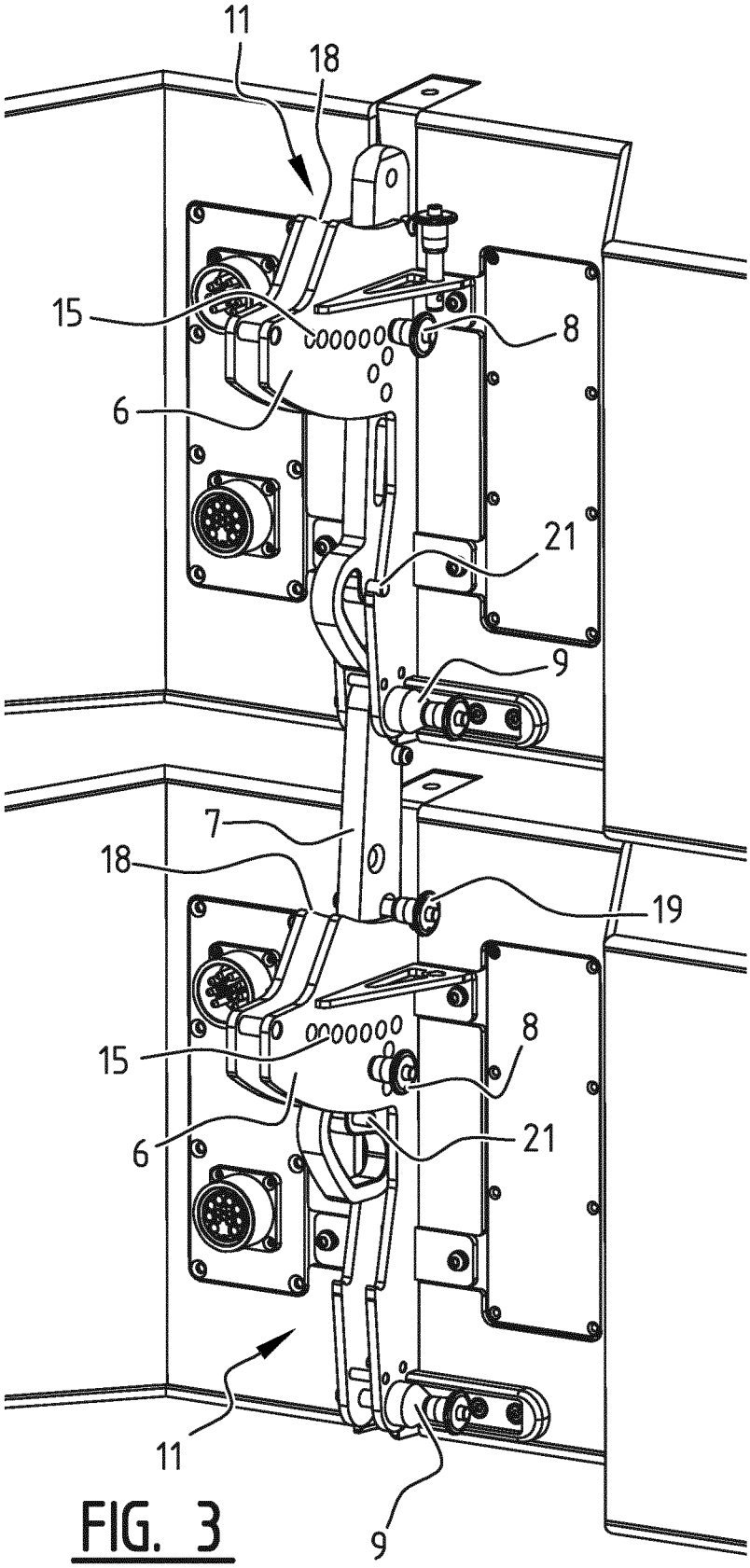
FIG. 3 is a detail of the perspective view of the back side of the two adjacent speakers of the loudspeaker array of FIG. 2.
Figure 4:
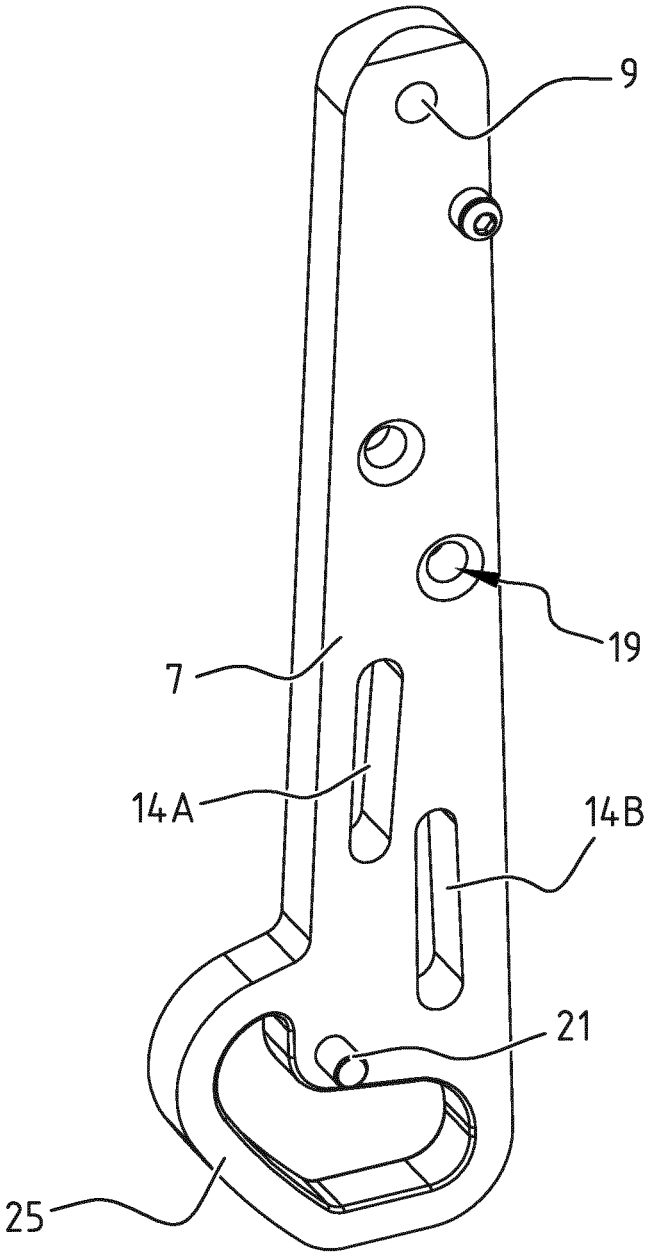
FIG. 4 is a perspective view of the pivotable connection bar used in the loudspeaker array of FIG. 1.

FIG. 2 shows two adjacent loudspeaker housings 2. The front sides of two adjacent loudspeaker housings 2 are mutually connected by hinges 5. A space 13 is provided in the centre of the loudspeaker housing 2, in which space a coupling system is mounted. The space 13 is a through recess which extends from the upper surface to the lower surface of the loudspeaker housing 2, parallel to the lateral surfaces. The coupling system comprises coupling means 11 for coupling to loudspeaker housings 2 together and for setting the angle 3 between the two loudspeaker housings 2. The coupling system is shown in detail in FIG. 3.

The coupling means 11 comprise a stationary connection frame 6, a pivotable connection bar 7 and a first connection pin 8 for connecting the outer end of the connection bar 7 of one loudspeaker to the connection frame 6 of the adjacent loudspeaker, in this case the lower adjacent lower adjacent loudspeaker.

The stationary connection frame 6 is mounted on the back side of the loudspeaker housings. The pivotable connection bar 7 is at one end pivotably connected to said frame 6 near the lower end thereof by means of a second connection pin 9. The other end of the pivotable connection bar 7 is provided with a handle 25 for easy operation.

The pivotable connection bar 7 is provided with two slots 14A, 14B, which both extend in the direction of the pivot point of the bar 7. The lower end of slot 14 A and the upper end of slot 14 B form stops against which the first connection pin 8 can rest in the final hoisted condition of the loudspeaker array, in order to maintain the desired angle 3 between the loudspeakers. Because the locations of the two stops in the slots 14A, 14C are located at the same distance from the pivot point 9 of the pivotable connection bar 7, a hole 15 corresponds to the same angle 3 between the loudspeakers in both the fly mode and the compression mode of operation.

The connection frame 6 is provided with a plurality of holes 15 which are arranged to hold the first connection pin 8. The holes 15 extend in an arcuate array in a direction which is substantially perpendicular to the slots 14A, 14B. Each hole 15 is located at a different distance from the pivot point 9 of the connection bar 7, in order to cause different angles 3 between the adjacent loudspeakers. While the loudspeaker array is extending in a straight line in the non-hoisted condition, rotating the connection bar 7 and coupling the connection bar 7 to the connection frame 6 by inserting the pin 8 through one of said holes 15 and either the slot 14A (in fly mode) or slot 14B (in compression mode) determines the angle 3 between the speaker housings 2 in the final hoisted condition. When the loudspeaker array is then hoisted the pin 8 will move in the respective slot 14A, 14B to the stop position, either by gravity in the fly mode as shown in FIGS. 5 A-C or by pulling a tension cable 16 in the compression mode as shown in FIGS. 6 A-C.

Figure 5C:
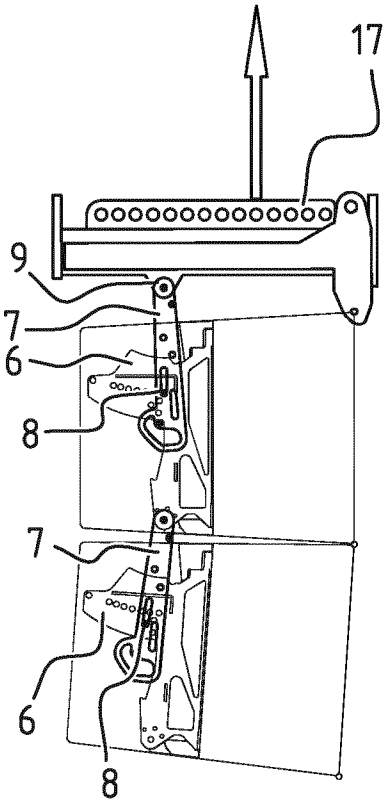
FIG. 5A, 5B, 5C are side views of the loudspeaker array being hoisted in flying mode at different stages.
Figure 5B:
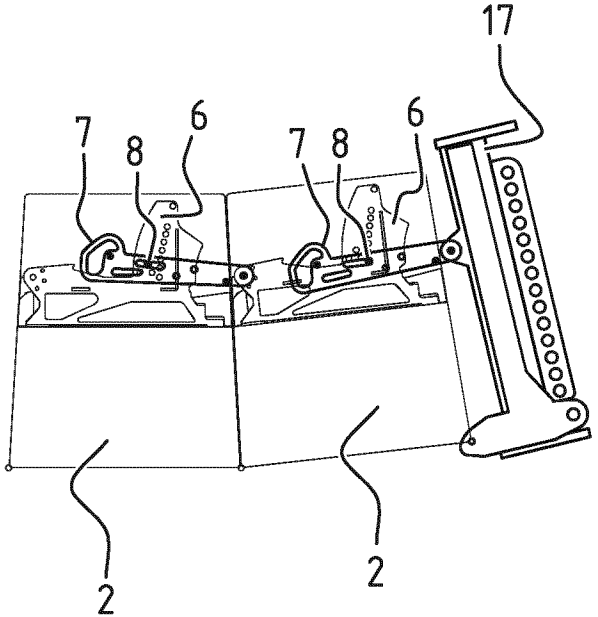
Figure 5A:
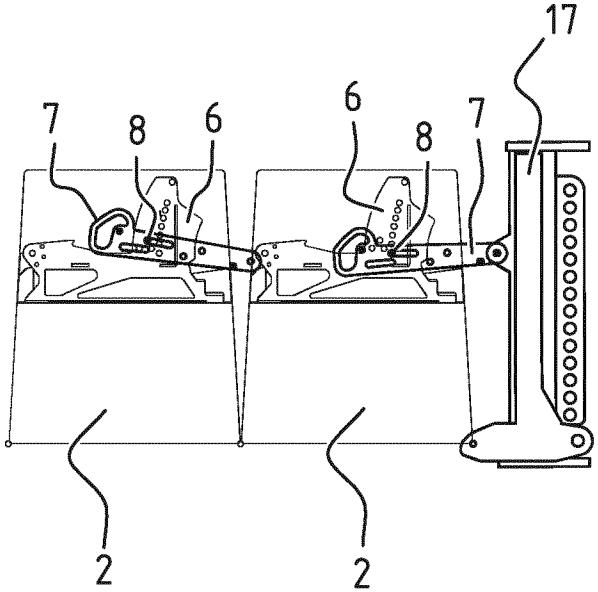

According to FIGS. 5 A-C when the upper loudspeaker housing 2 is hoisted from a horizontally extending position as shown in FIG. 5A such that the back sides of the speakers are first pushed against each other as shown in FIG. 5B, at which point the second pin 9 of the connection bar 7 can be connected to the connection frame 6 wo form the hingeable connection, while the correct hole 15 of the connection frame 6 is chosen to be connected to the slot 14A at the other end of the connection bar 7, and thereafter upon further hoisting gravity forces the back sides of the loudspeaker housings to move away relative to each other such that the first connection pins 8 move towards the lower stops in slots 14A, as shown in FIG. 5C.

Figure 6C:
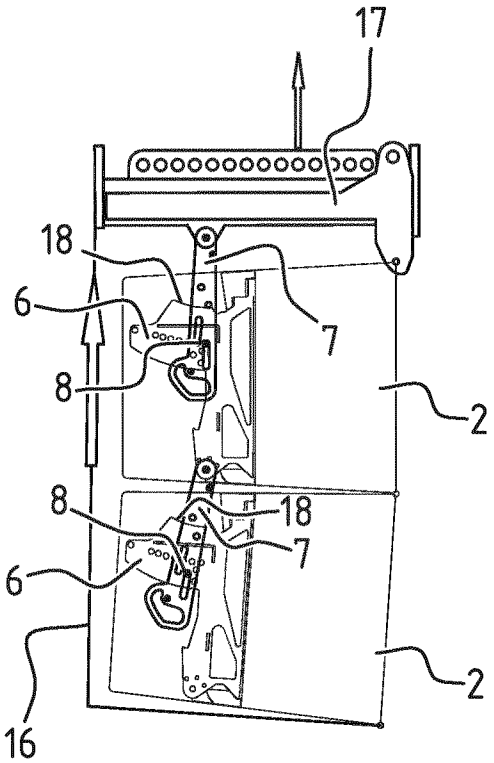
FIG. 6A, 6B, 6C are side views of the loudspeaker array being hoisted in compression mode at different stages.

According to FIGS. 6 A-C the loudspeaker array is provided with a tension cable 16, one end of which is attached to the back side of the lower loudspeaker housing 2 in the loudspeaker array, and one end of which is attached near the upper side of said loudspeaker array to the hoist frame 17. The hoist frame 17 comprises for tensioning the cable 16, which forces the back sides of the loudspeaker housings to move towards each other such that the first connection pins 8 move towards the upper stops in slots 14B.

Figure 6B:
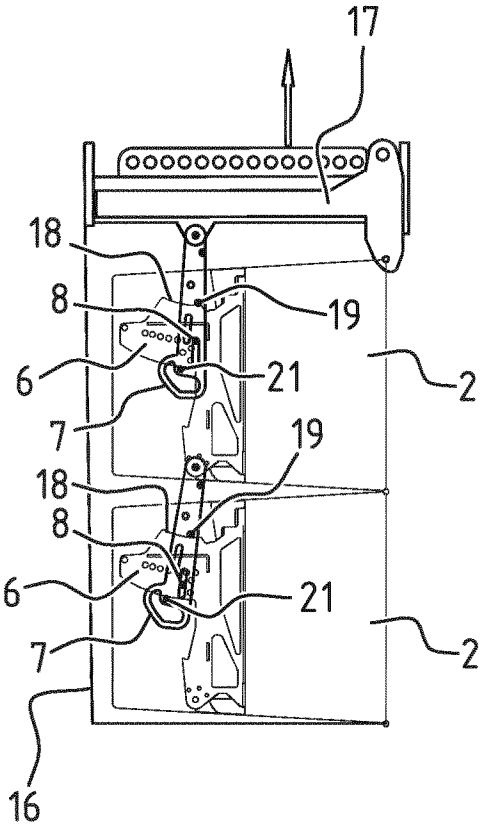
Figure 6A:
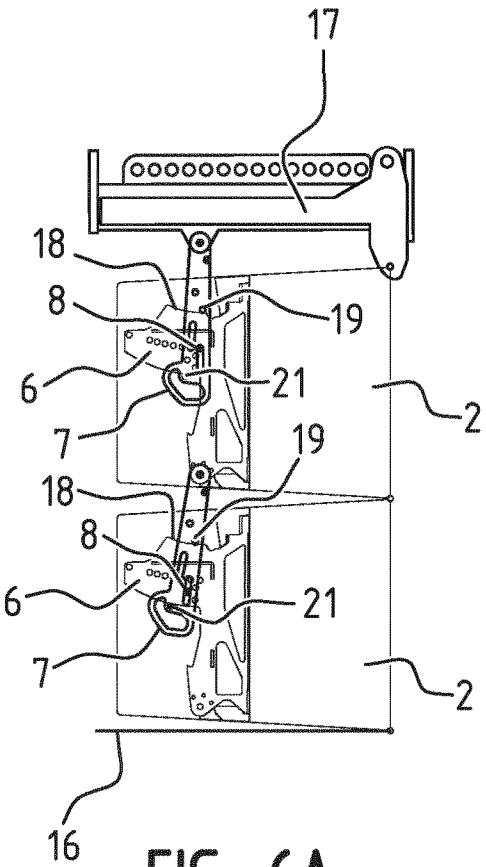

In the compression mode the loudspeaker array is normally standing on the floor in a vertical pile before it is hoisted. In order to be able to set the angle 3 between each pair of adjacent loudspeaker housings 2 by rotating the connection bar 7 and coupling the connection bar 7 to the connection frame 6 by inserting the pin 8 through one of said holes 15 and slot 14B, the connection frame 6 is provided with a first support surface 18 extending in a segment of a circle, the centre of said circle being the pivot point 9 of the pivotable connection bar 7 when the loudspeaker array is in the non-hoisted, stretched position. The first support surface 18 is facing towards the pivot point of the connection bar 7. The connection bar 7 is provided with a hole with removable support pin 19 which is arranged to be pushed against and be movable along the support surface 18 when the connection bar 7 is rotated to select the desired hole 15 in the connection frame 6. In that manner the loudspeaker array is kept standing upright in the non-hoisted, stretched position while the support pin 19 is not removed, as shown in FIG. 6A. The support pin 19 can be removed when the loudspeaker array is being hoisted at the hoisting stage as shown in FIG. 6B, in order to allow the tension cable 16 to move the back sides of the loudspeaker housings 2 towards each other and thereby move the first connection pins 8 towards the upper stops in slots 14B, as shown in FIG. 6 C.

The connection frame 6 is furthermore provided with a second support surface 20, also extending in a segment of a circle, the centre of said circle also being the pivot point of the pivotable connection bar 7 when the loudspeaker array is in the non-hoisted, stretched position. The second support surface 20 is facing away from the pivot point of the connection bar 7. The connection bar 7 is provided with a second support pin 21 which is arranged to push against and be movable along said support surface 20 in order to hold said loudspeaker array in the stretched position when the loudspeaker array is hoisted, before the cable 16 is tensioned, as can be seen in FIG. 6 B.

The invention has thus been described by means of a preferred embodiment. It is to be understood, however, that this disclosure is merely illustrative. Various details of the structure and function were presented, but changes made therein, to the full extent extended by the general meaning of the terms in which the appended claims are expressed, are understood to be within the principle of the present invention. The description and drawings shall be used to interpret the claims. The claims should not be interpreted as meaning that the extent of the protection sought is to be understood as that defined by the strict, literal meaning of the wording used in the claims, the description and drawings being employed only for the purpose of resolving an ambiguity found in the claims. For the purpose of determining the extent of protection sought by the claims, due account shall be taken of any element which is equivalent to an element specified therein.

The invention claimed is:

1. A loudspeaker array suitable for use in both a compression suspension mode and a flying suspension mode, comprising at least two loudspeaker housings, wherein each two adjacent loudspeakers housings are coupled to each other by coupling means;

wherein said coupling means comprises a hinge connecting the front sides of said adjacent loudspeaker housings;

wherein said coupling means are designed to couple said adjacent loudspeakers in such a manner that the loudspeaker housings will extend at a predetermined angle relative to each other in a hoisted position, and provided with means for setting the predetermined angle when the loudspeaker housings are in a non-hoisted position;

wherein the coupling means are further designed for coupling the loudspeaker housings in such a manner that said loudspeaker housings, upon being moved from the non-hoisted position to the hoisted position, are moved to a position wherein the loudspeaker housings are forced to extend at said predetermined angle;

wherein said coupling means comprise a pivotable connection bar which at one end is pivotably connected to a back side of one of said adjacent loudspeakers, and a stationary connection frame mounted on a back side of the other one of said adjacent loudspeakers and to which the other end of said connection bar can be coupled by means of a connection member;

wherein one of said connection frame and bar is provided with a plurality of holders which are arranged to hold said connection member, and arranged such that a selection of each one of said holders by rotating said connection bar for holding said connection member and coupling said connection bar to said connection frame determines a different said predetermined angle; and wherein the other one of said connection frame and bar is provided with a fly mode pulling connection member stop and a compression mode pushing connection member stop which each are arranged to receive and block movement of said connection member in two opposite directions, one being a fly mode direction and one being a compression mode direction, such that blocking the movement of said connection member in the fly mode direction causes the back sides of said loudspeaker housings to exert a pulling force on each other while maintaining said predetermined angle and blocking the movement of said connection member in the compression mode direction causes the back side of said loudspeaker housings to exert a pushing force on each other while maintaining said predetermined angle.

2. The loudspeaker array according to claim 1, wherein the designated connection member locations of said fly mode connection member stop and said compression mode connection member stop are located at the same distance from the pivot point of said pivotable connection bar.

3. The loudspeaker array according to claim 1, wherein said connection member stops are formed by the ends of slots wherein said connection member can move.

4. The loudspeaker array according to claim 3, wherein said slots extend in the fly mode and compression mode directions respectively, each of said directions extending through the pivot point of said pivotable connection bar.

5. The loudspeaker array according to claim 1, wherein said plurality of holders for holding said connection member extends in an array in a direction which is substantially perpendicular to the fly mode and compression mode directions.

6. The loudspeaker array according to claim 1, wherein said loudspeaker array is provided with a tension cable, one end of which is attached to the back side of the lower loudspeaker in said loudspeaker array, and one end of which is attached near the upper side of said loudspeaker array, and means for tensioning said cable in order to move said connection members in the compression mode direction towards the compression mode connection member stops.

7. The loudspeaker array according to claim 1, wherein said loudspeaker array is designed such that when the upper loudspeaker of said loudspeaker array is hoisted gravity forces said loudspeakers to move such that said connection members move in the fly mode direction towards the fly mode connection member stops.

8. The loudspeaker array according to claim 1, wherein said plurality of holders is provided in the stationary connection frame and the connection member is provided in the pivotable connection bar.

9. The loudspeaker array according to claim 1, wherein said connection member is a pin.

10. The loudspeaker array according to claim 1, wherein said holder is a pin hole in which a pin can be inserted.

11. The loudspeaker array according to claim 1, wherein said connection frame or bar which is provided with said holders for said connection member is provided with a support surface extending in a segment of a circle, the centre of said circle being the pivot point of said pivotable connection bar when said loudspeaker array is in the non-hoisted, stretched position;

wherein the other one of said connection frame and bar is provided with a removable support member which is arranged to push against and be movable along said support surface when said connection bar is rotated in order to hold said loudspeaker array standing upright in the non-hoisted, stretched position, which removable support member can be removed when the loudspeaker array is hoisted in order to allow a tension cable, one end of which is attached to the back side of the lower loudspeaker in said loudspeaker array, and one end of which is attached near the upper side of said loudspeaker array, and means for tensioning said cable, to move said connection members in the compression mode direction towards the compression mode connection member stops.

12. The loudspeaker array according to claim 1, wherein said connection frame or bar which is provided with said holders for said connection member is provided with a second support surface extending in a segment of a circle, the centre of said circle being the pivot point of said pivotable connection bar when said loudspeaker array is in the non-hoisted, stretched position;

wherein the other one of said connection frame and bar is provided with a second support member which is arranged to push against and be movable along said support surface in order to hold said loudspeaker array in a stretched position when the loudspeaker array is hoisted.

13. A loudspeaker array suitable for use in a compression suspension mode, comprising at least two loudspeaker housings, wherein each two adjacent loudspeakers housings are coupled to each other by coupling means;

wherein said coupling means comprises a hinge connecting the front sides of said adjacent loudspeaker housings;

wherein said coupling means are designed to couple said adjacent loudspeakers in such a manner that the loudspeaker housings will extend at a predetermined angle relative to each other in a hoisted position, and provided with means for setting the predetermined angle when the loudspeaker housings are in a non-hoisted position;

wherein the coupling means are further designed for coupling the loudspeaker housings in such a manner that said loudspeaker housings, upon being moved from the non-hoisted position to the hoisted position, are moved to a position wherein the loudspeaker housings are forced to extend at said predetermined angle;

wherein said coupling means comprise a pivotable connection bar which at one end is pivotably connected to a back side of one of said adjacent loudspeakers, and a stationary connection frame mounted on a back side of the other one of said adjacent loudspeakers and to which the other end of said connection bar can be coupled by means of a connection member;

wherein one of said connection frame and bar is provided with a plurality of holders which are arranged to hold said connection member, and arranged such that a selection of each one of said holders by rotating said connection bar for holding said connection member and coupling said connection bar to said connection frame determines a different said predetermined angle; and wherein the other one of said connection frame and bar is provided with a compression mode pushing connection member stop which is arranged to receive and block movement of said connection member in a compression mode direction, such that blocking the movement of said connection member in the compression mode direction causes the back side of said loudspeaker housings to exert a pushing force on each other while maintaining said predetermined angle.

14. The loudspeaker array according to claim 13, wherein said connection frame or bar which is provided with said holders for said connection member is provided with a support surface extending in a segment of a circle, the centre of said circle being the pivot point of said pivotable connection bar when said loudspeaker array is in the non-hoisted, stretched position;

wherein the other one of said connection frame and bar is provided with a removable support member which is arranged to push against and be movable along said support surface when said connection bar is rotated in order to hold said loudspeaker array standing upright in the non-hoisted, stretched position, which removable support member can be removed when the loudspeaker array is hoisted in order to allow a tension cable, one end of which is attached to the back side of the lower loudspeaker in said loudspeaker array, and one end of which is attached near the upper side of said loudspeaker array, and means for tensioning said cable, to move said connection members in the compression mode direction towards the compression mode connection member stops.

15. The loudspeaker array according to claim 13, wherein said connection frame or bar which is provided with said holders for said connection member is provided with a second support surface extending in a segment of a circle, the centre of said circle being the pivot point of said pivotable connection bar when said loudspeaker array is in the non-hoisted, stretched position;

wherein the other one of said connection frame and bar is provided with a second support member which is arranged to push against and be movable along said support surface in order to hold said loudspeaker array in a stretched position when the loudspeaker array is hoisted.

16. The loudspeaker array according to claim 13, wherein said connection member stops are formed by the ends of slots wherein said connection member can move.

17. The loudspeaker array according to claim 13, wherein said slot extends in the compression mode direction, extending through the pivot point of said pivotable connection bar.

18. The loudspeaker array according to claim 13, wherein said plurality of holders for holding said connection member extends in an array in a direction which is substantially perpendicular to the compression mode direction.

19. The loudspeaker array according to claim 13, wherein said plurality of holders is provided in the stationary connection frame and the connection member is provided in the pivotable connection bar.

20. The loudspeaker array according to claim 13, wherein said connection member and/or support member(s) is/are a pin.

21. The loudspeaker array according to claim 1, wherein said holder is a pin hole in which a pin can be inserted.

22. The loudspeaker array according to claim 13, suitable for use in both a compression suspension mode and a flying suspension mode, wherein the other one of said connection frame and bar is provided with a fly mode pulling connection member stop which is arranged to receive and block movement of said connection member in a fly mode direction being opposite to said compression mode direction, such that blocking the movement of said connection member in the fly mode direction causes the back sides of said loudspeaker housings to exert a pulling force on each other while maintaining said predetermined angle.

23. The loudspeaker array according to claim 22, wherein the designated connection member locations of said fly mode connection member stop and said compression mode connection member stop are located at the same distance from the pivot point of said pivotable connection bar.

24. The loudspeaker array according to claim 23, wherein said loudspeaker array is designed such that when the upper loudspeaker of said loudspeaker array is hoisted gravity forces said loudspeakers to move such that said connection members move in the fly mode direction towards the fly mode connection member stops.

* * * * *